US005512002A

United States Patent [19]

Lieberman

[11] Patent Number: 5,512,002

[45] Date of Patent: Apr. 30, 1996

[54] INFLATABLE RACING CAR

[75] Inventor: Marvin S. Lieberman, New York, N.Y.

[73] Assignee: Alvimar Manufacturing Company, Inc., Long Island City, N.Y.

[21] Appl. No.: 275,152

[22] Filed: Jul. 14, 1994

[51] Int. Cl.[6] ..... A63H 3/06; A63H 17/26

[52] U.S. Cl. ..... 446/221; 446/223; 446/225; 446/471

[58] Field of Search ..... 446/7, 220, 221, 446/222, 223, 224, 225, 226, 465, 470, 471, 490, 491, 220–226

[56] References Cited

U.S. PATENT DOCUMENTS

| | | | |
|---|---|---|---|
| 1,485,577 | 3/1924 | Witten | 446/220 |
| 1,765,435 | 6/1930 | McBride | 446/225 |
| 1,881,048 | 10/1932 | Dorogi et al. | 446/220 X |
| 3,801,403 | 4/1974 | Lucek | 446/220 X |
| 4,146,992 | 4/1979 | Smith | 446/465 |
| 4,223,474 | 9/1980 | Strauss | 446/221 |
| 4,678,451 | 7/1987 | Ventura | 446/471 |
| 4,895,546 | 1/1990 | Rakonjac | 446/221 |
| 5,131,880 | 7/1992 | Nesbit et al. | 446/221 X |
| 5,273,477 | 12/1993 | Adams, Jr. | 446/220 X |
| 5,335,436 | 8/1994 | Gurr | 446/226 X |

FOREIGN PATENT DOCUMENTS

| | | | |
|---|---|---|---|
| 2808436 | 8/1979 | Germany | 446/470 |

*Primary Examiner*—Robert A. Hafer
*Assistant Examiner*—D. Neal Muir
*Attorney, Agent, or Firm*—Rosen, Dainow & Jacobs

[57] ABSTRACT

An inflatable racing car is formed of a plurality of separate air chambers which are combined in fixed relationship to each other to form the vehicle which is suitable as a display or toy or sculptural work of art. For each left/right wheel-set there is a cylindrical air chamber terminating at each end in the form of a tire. A third air chamber is formed somewhat like a partially flattened egg which represents the passenger compartment situated above and between the two wheel-sets. A fourth inflatable chamber is the remainder of the car body which generally encompasses the wheel-sets and supports the passenger compartment. Within the car body are numerous webs formed as flat sheets of plastic positioned transversely with respect to various outside walls so that when the body is inflated these webs prevent these opposite walls from extending excessively outward and leading to an improper shape. The four air chambers cooperate to provide strength, realism and economy of manufacture.

20 Claims, 7 Drawing Sheets

INFLATABLE RACING CAR

BACKGROUND OF THE INVENTION

The present invention is in the field of inflatable objects which may be toys, displays or works of art. To form such objects on a high volume basis and extreme low cost basis while retaining a high degree of realism is a perpetual challenge. This challenge is even greater when the object is substantially large. A further challenge is to have this high volume object at an extremely low price and finally to achieve this with a minimum of difficulty in manufacture, storage and shipping.

Typically model vehicles, animals or buildings are often made of plastic in a rigid or semi-rigid form which occupies a great deal of space and renders such objects substantially impractical for high volume, low price especially as regards storage, shipment and/or display at point of sale.

Many objects whether they be vehicles, buildings, animals or even replicas of humans when they are inflatable have severe limitations as to realism because inflatable objects tend to be simply balloons which inherently expand with internal air pressure to a generally bulbous shape. As any intricate design elements are attempted the cost of manufacture increases substantially, and to a large extent desirable details have heretofore been generally impossible or impractical. Typically, all parts of the flexible plastic material tend to extend outward from the internal air inflation pressure; it is thus impractical to have design aspects extend inward from inflation, and this is a significant design limitation.

SUMMARY OF THE PRESENT INVENTION

This invention overcomes a great many of the difficulties and restrictions discussed above in regard to the prior art and achieves a highly realistic inflatable racing car which is substantially large, relatively inexpensive to manufacture, and reasonably inexpensive to store and ship in its uninflated essentially flat condition. This simulated racing car achieves extreme realism with its recessed wheel wells which surround and house independent inflatable wheels along with other features which combined produce a new kind of inflatable article.

In part this invention is achieved by using separate air chambers for various components of the car and integrating them all into one unified structure; another innovative aspect is the use of appropriate internal webs or struts to constrain the flexible plastic sheet from extending excessively outward from the internal pressure in those areas where it is intended to maintain a relatively flat surface such as the top of the hood, the top of the trunk deck and the bottom of the car. This construction feature is also used with the wheels to create relatively flat sidewalls as real tires have and to have relatively flat inwardly recessed hub cap as appears in real racing car tires and wheels. These and other features will be described with reference to the drawings of the preferred embodiments as further described herein.

DETAILED DESCRIPTION OF THE PREFERRED EMBODIMENT

Figure 1:
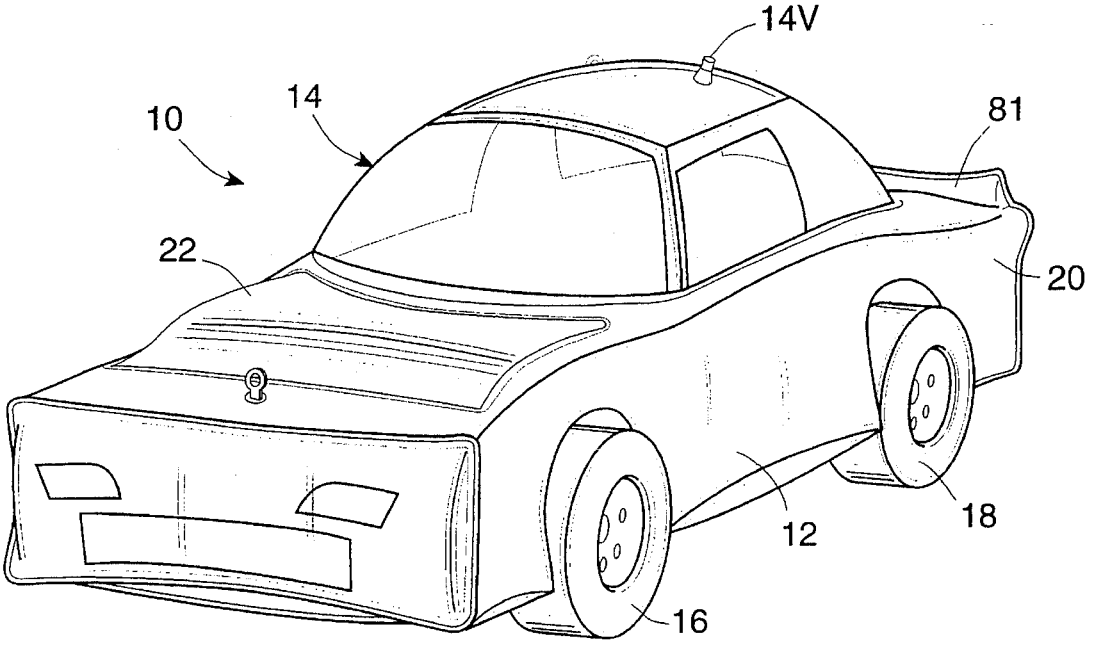
FIG. 1 is a front perspective view of the new inflatable racing car.
Figure 6:
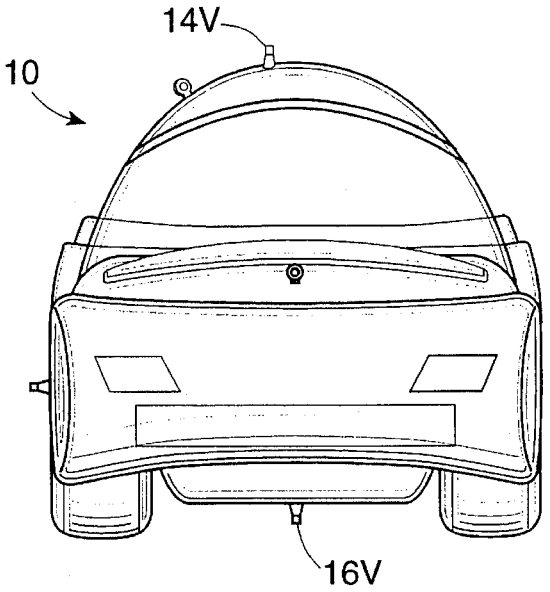
FIG. 6 is a front elevation view thereof.

The new inflatable simulated racing car is shown as item 10 in all the figures. This car has an overall housing 12, a simulated passenger compartment 14, a front wheel sub-assembly 16, a rear wheel sub-assembly 18, a rear trunk area 20 and a front hood area 22.

Figure 12:
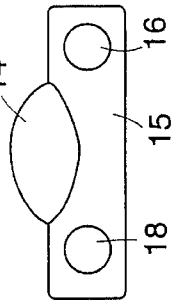
FIG. 12 is a schematic drawing showing the four air chambers forming the car.
Figure 13:
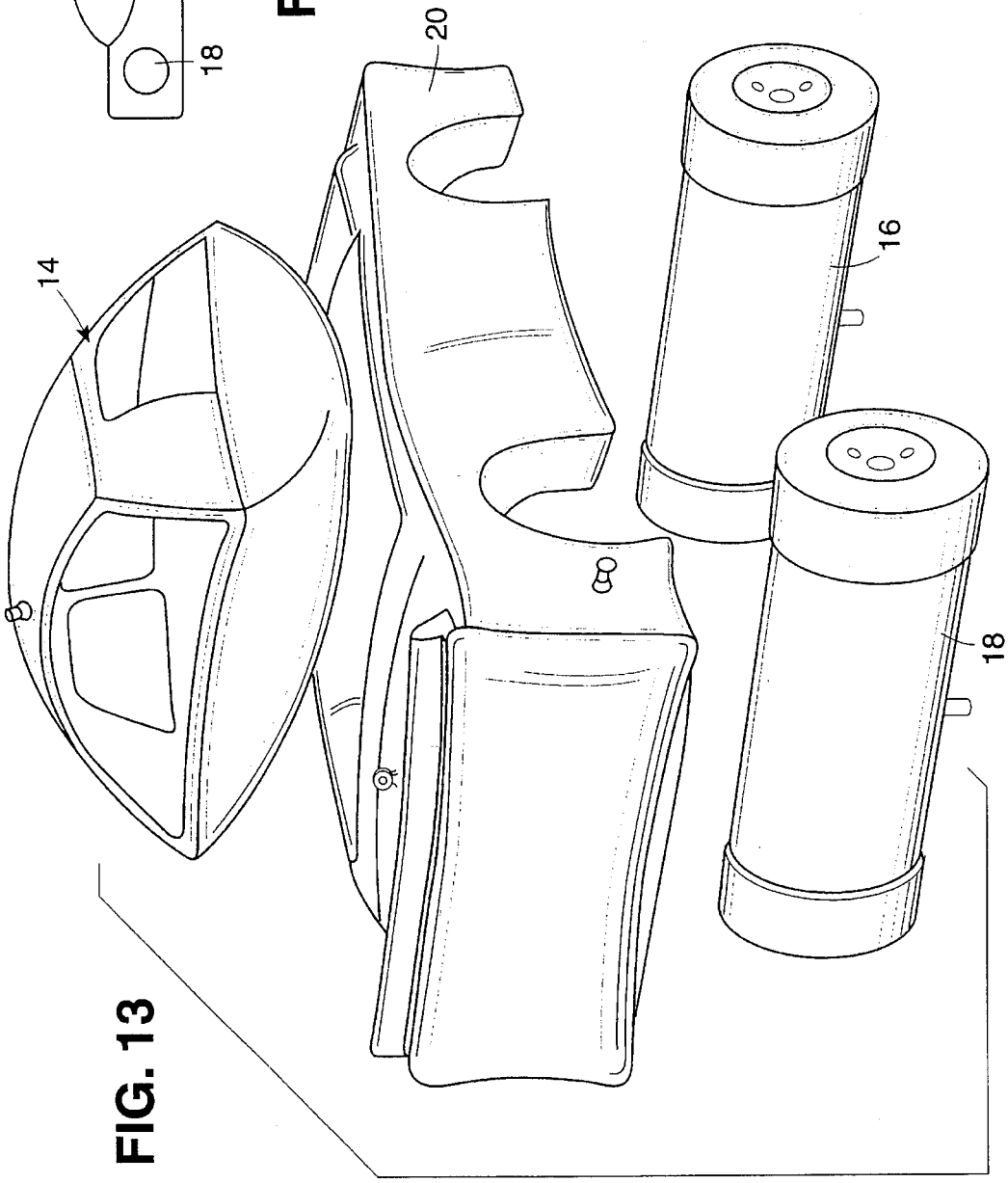
FIG. 13 is a schematic drawing in perspective showing the four air chambers forming the car.

There are four independent air chambers in this car, each having its own valve, as shown schematically in FIGS. 12 and 13 and in detail in FIGS. 1–11. The first two air chambers are the front and rear wheel sub-assemblies respectively, 16 and 18 which have corresponding valves 16V and 18V shown in FIGS. 3, 5, 6, 8 and 10. Next there is passenger chamber 14 with its valve 14V at the top of the passenger compartment. The fourth air chamber comprises the remaining areas including the front hood area 22, the rear trunk area 20, and connecting passages along the bottom and elsewhere connecting the hood and trunk areas, this fourth air chamber having valve 20V.

Figure 2:
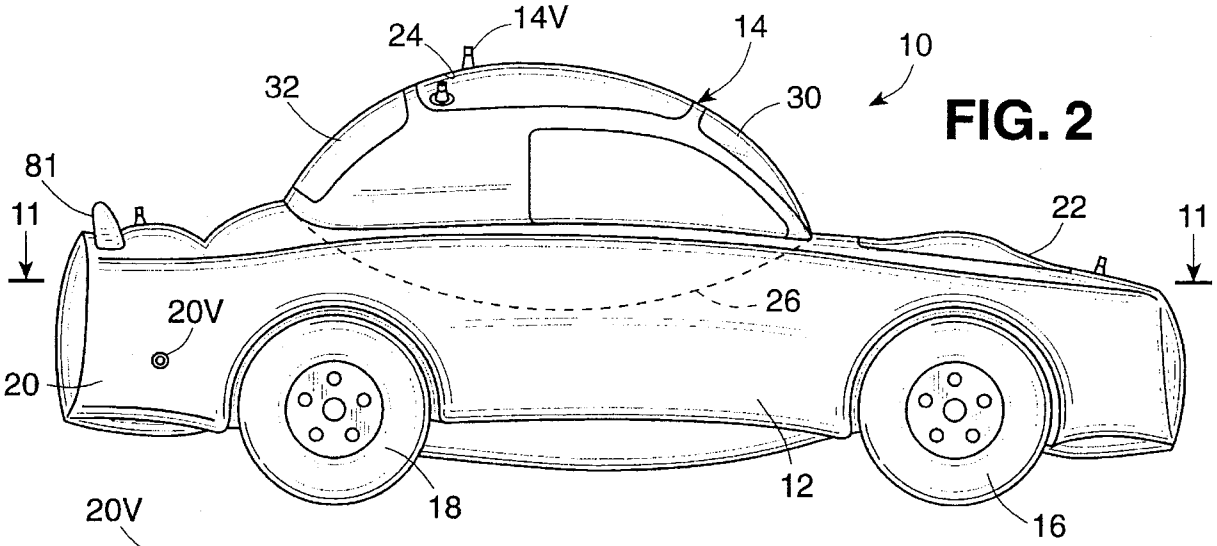
FIG. 2 is a left side elevation view thereof.
Figure 3:
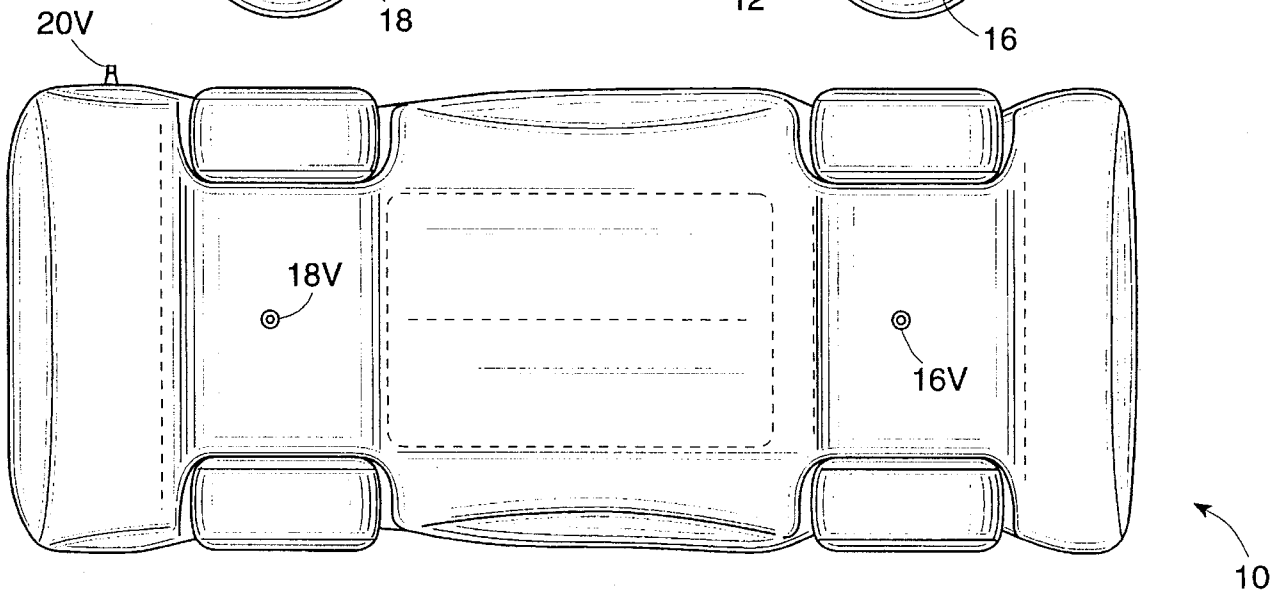
FIG. 3 is a bottom plan view thereof.
Figure 4:
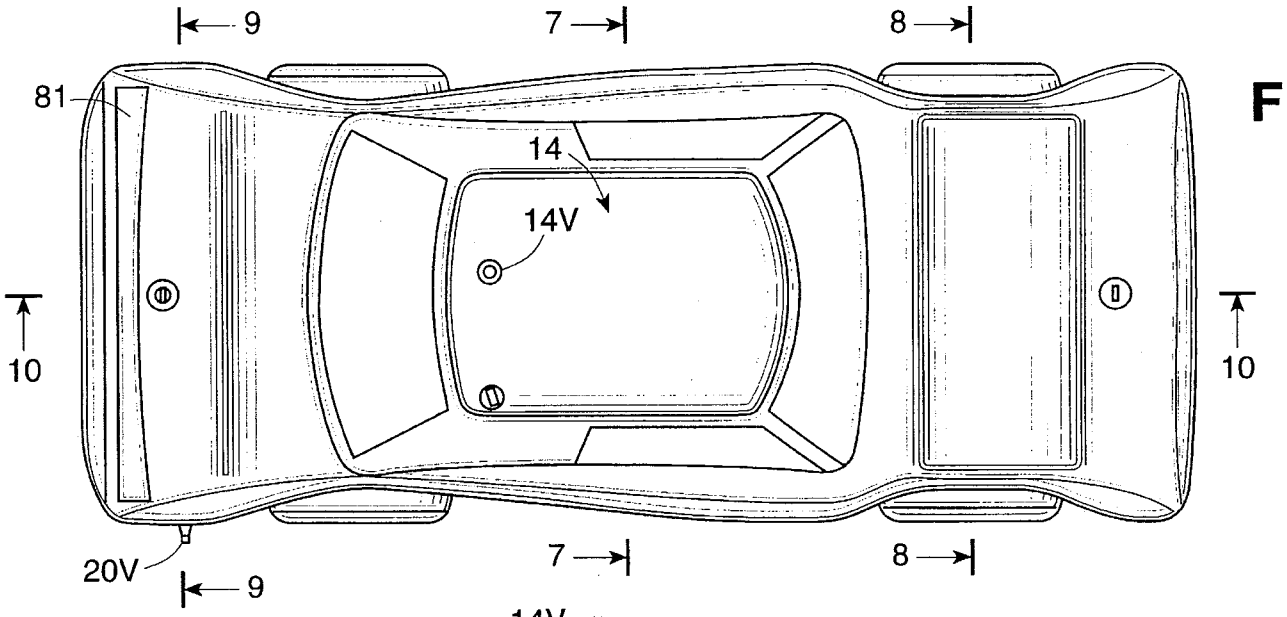
FIG. 4 is a top plan view thereof.
Figure 5:
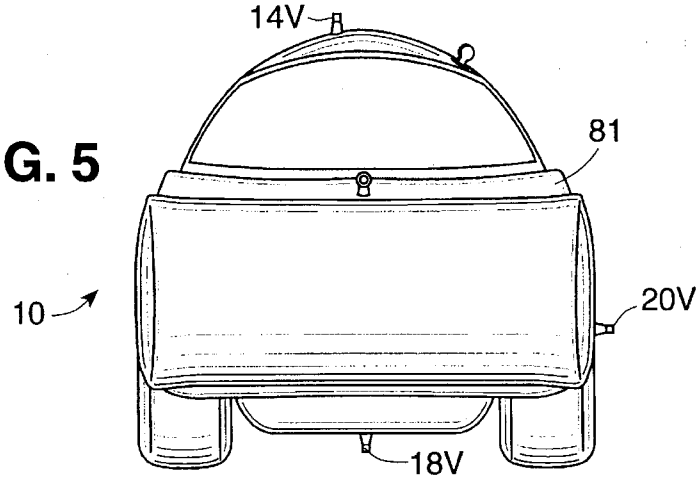
FIG. 5 is a rear elevation view thereof.

FIG. 4 shows the valve 14V at the top of the passenger compartment for inflating compartment 14, as shown more clearly in FIGS. 1 and 2; and FIGS. 3 and 4 show a valve 20V extending out of the right rear fender which inflates the remaining fourth chamber. This chamber extends from the rear trunk to the front hood passing along the side and bottom of the car below and adjacent the passenger chamber 14.

Figure 7:
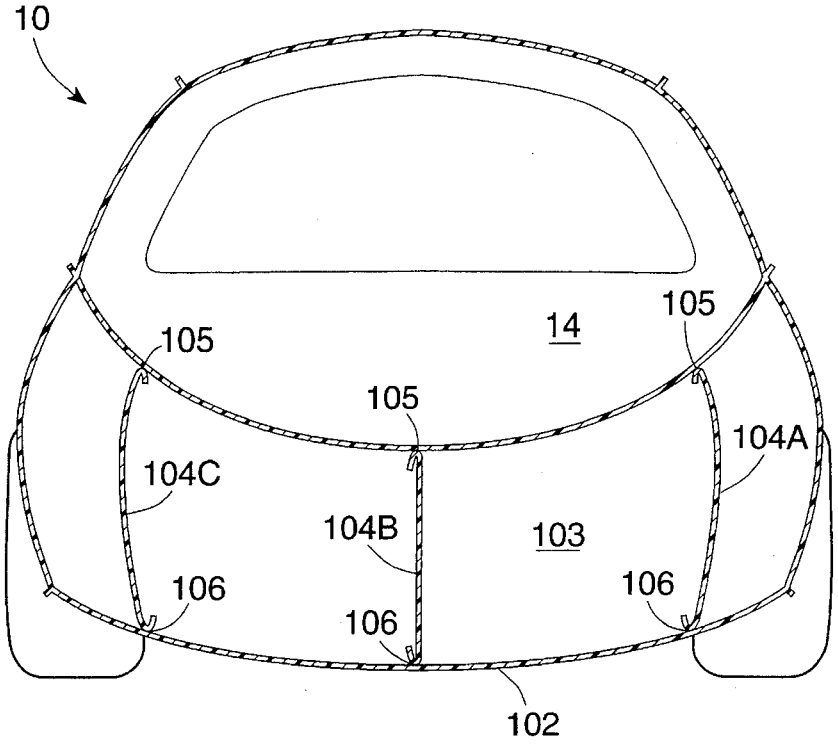
FIG. 7 is a sectional view taken along line 7—7 of FIG. 4.
Figure 10:
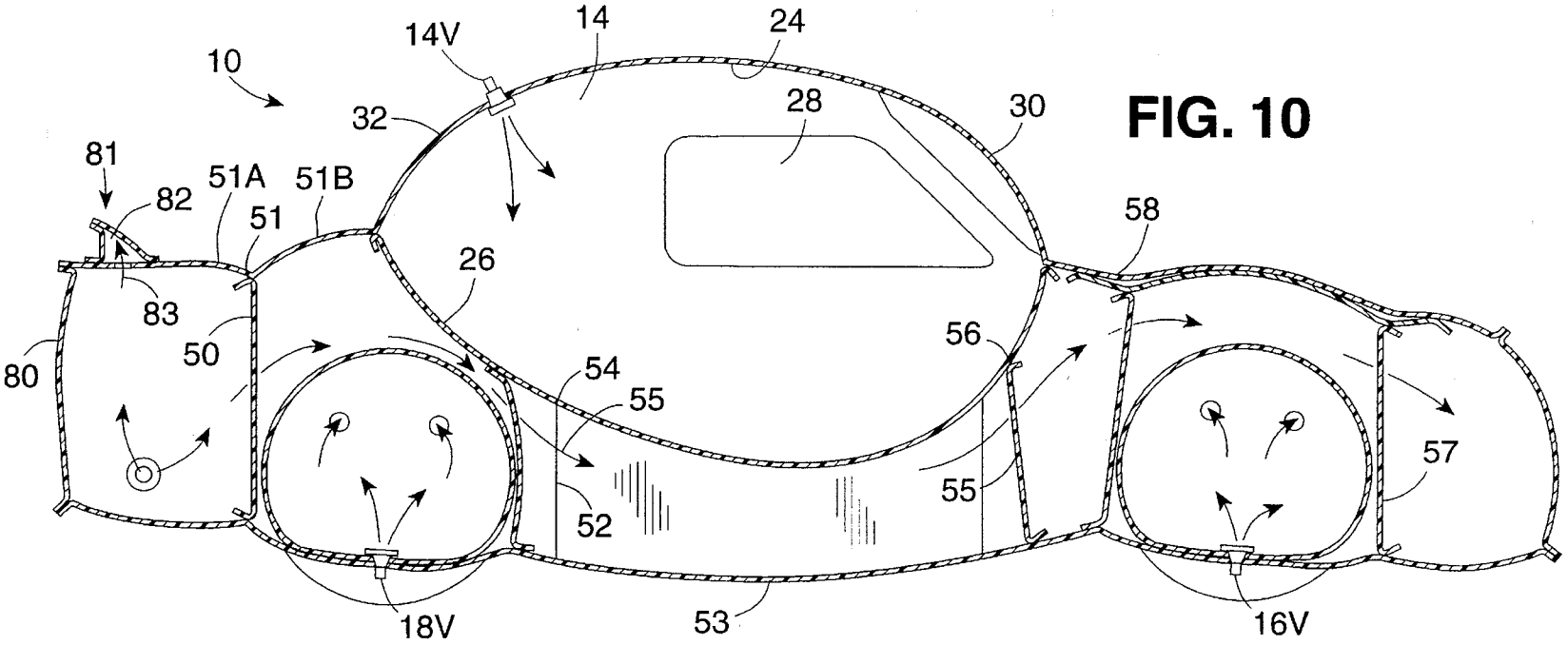
FIG. 10 is a sectional view taken along lines 10—10 of FIG. 4.
Figure 9:
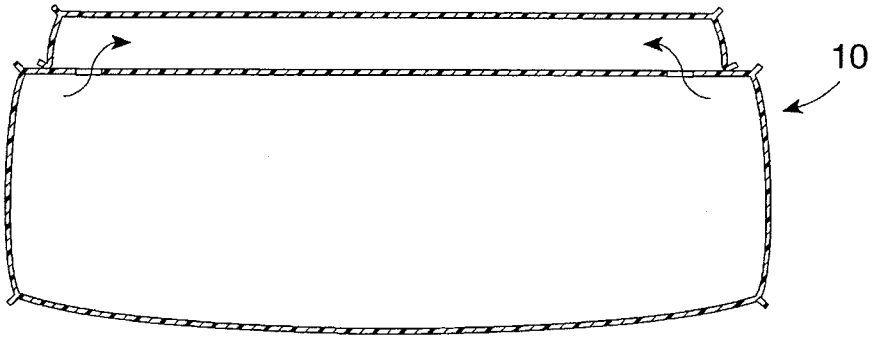
FIG. 9 is a sectional view taken along line 9—9 of FIG. 4.
Figure 11:
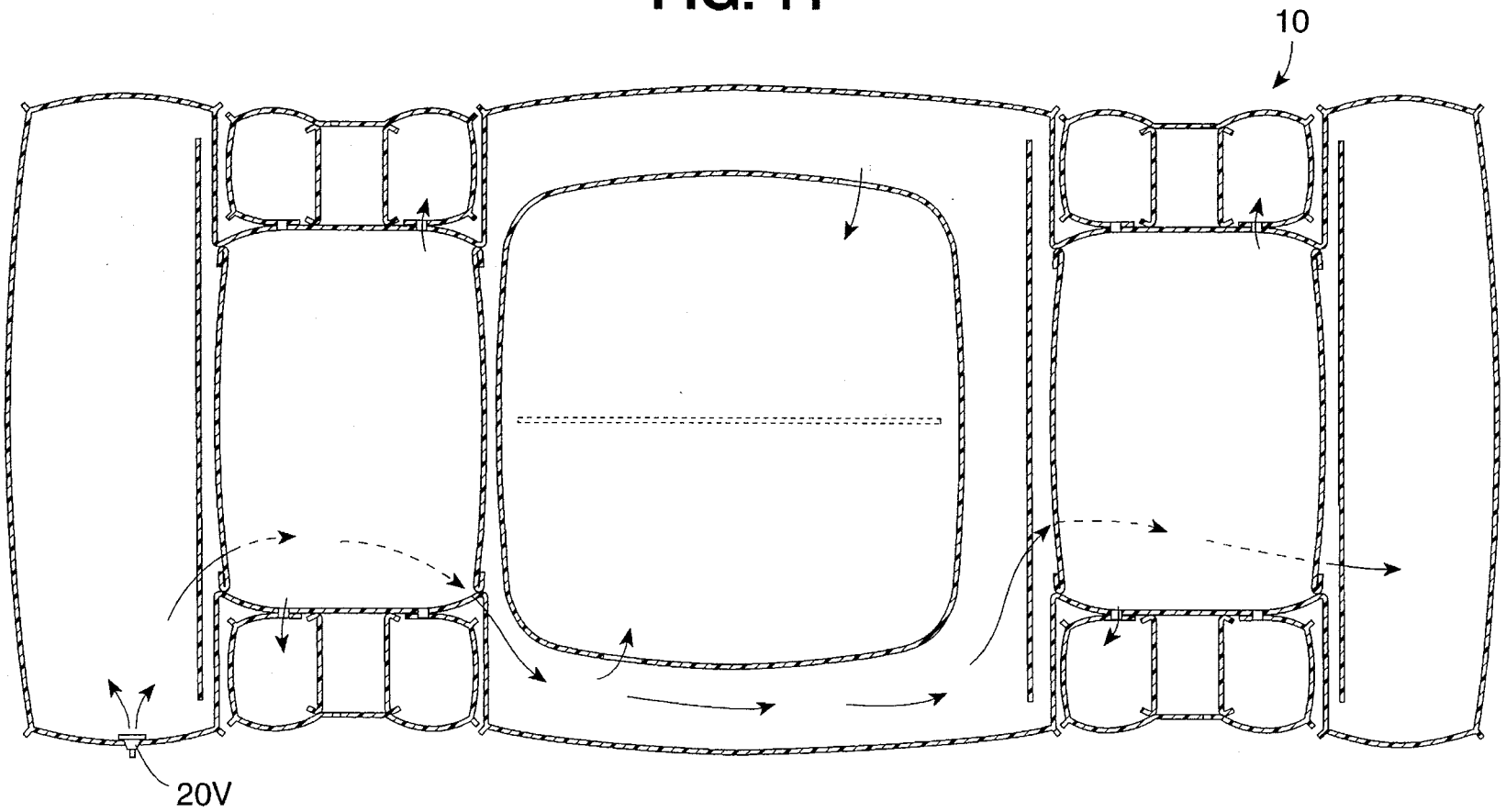
FIG. 11 is a sectional view taken along line 11—11 of FIG. 2.

The passenger chamber 14 seen in cross-section in FIGS. 7, 10 and 13 looks somewhat oval or lemon shaped, or as a partially flattened sphere and as seen in FIG. 4 top view is somewhat rectangular. In FIG. 10 this chamber has a smooth curved top 24 and a similar but opposite smooth curved bottom 26 with side windows 28 and front windows 30. Black lines represent window frames and support structure found in a real automobile. Also there are rear windows 32 somewhat similar to the front windows as regards shape, position and orientation of the front windows and front frame elements.

Figure 8:
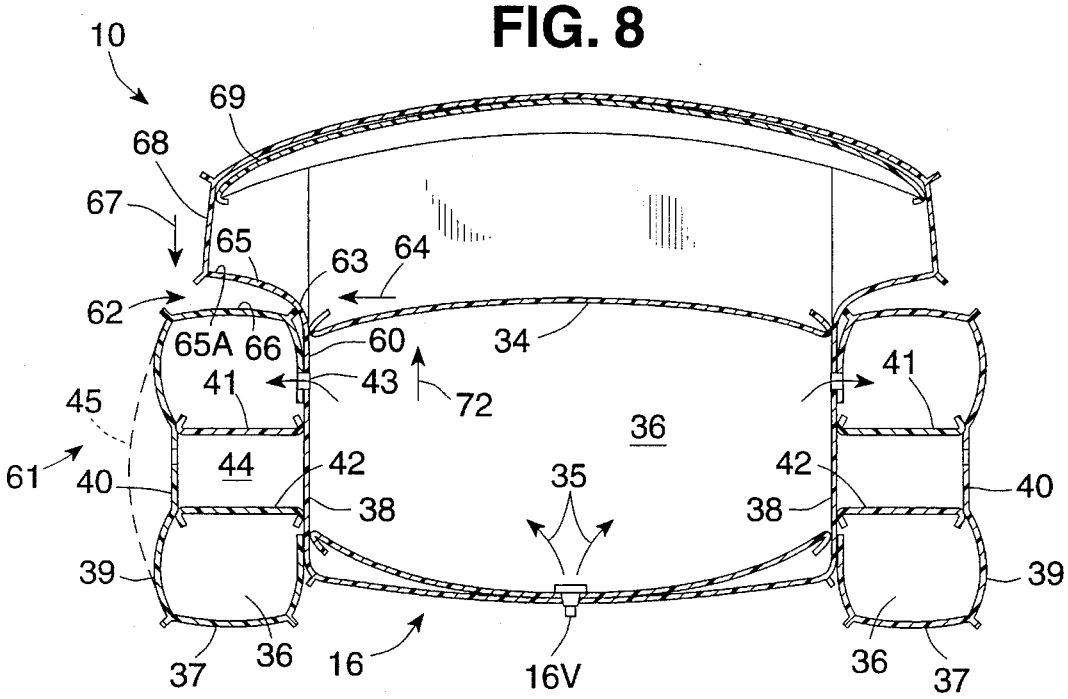
FIG. 8 is a sectional view taken along line 8—8 of FIG. 4.

Of the inflatable wheel assemblies 16 and 18, the front wheel assembly 16 is typical and is described as follows. This assembly shown in FIG. 2 and in cross-section FIG. 8 includes a cylindrical air chamber 34 terminating at both ends in a wheel 36 which has a tread portion 37 and inner wall 38, outer wall 39, a hub cap 40 and internal support webs 41 and 42. Valve 16V, shown in bottom plan view FIG. 3 appears also in FIGS. 3, 8 and 10. As seen in FIG. 8 air entering this valve follows arrows 35 into chamber 36 which is inflated as a cylinder. Air continues through aperture 43 which fills the torrid or doughnut-like wheels or tires. The chamber 44 at the center area of the wheel has air in it but not under pressure. Walls 41 and 42 define a cylinder concentric with the whole tire. These walls act as support webs to prevent outer wall 39 from billowing outward as indicated by dotted line 45 which would occur if the cylinder of walls 41 and 42 was not present. This helps to establish the generally flat-wall shape of the tires which is generally realistic of a real tire. This web or cylinder 41 and 42 also maintains the shape, position and orientation of the hub cap 40 to be flat and slightly recessed as often occurs in a real wheel. The right side of FIG. 8 represents the front right wheel and is structured essentially the same as the front left wheel that has been described in detail above.

The rear wheel assembly 18 as appears in FIGS. 1 and 2 and elsewhere is generally similar to that of the front wheel assembly, namely having a central cylindrical inflatable chamber with inflatable wheels on the two opposite ends somewhat like a dumb bell. As with the front wheel, there are support webs in the wheel itself to keep the outside walls from extending outward and thus being relatively flat as a real wheel would appear.

The fourth air chamber 15 is essentially the remainder of the car's body extending from the front hood area 22 to the rear trunk area 20 as seen in FIG. 2, thus front and rear parts and an intermediate area therebetween. The valve for inflating this chamber is indicated at 20V in FIGS. 3, 4 and 5. This body or housing contains the front and rear wheel air chambers and the passenger compartment chamber. More specifically the passenger chamber sits above and is fixedly secured to the body part, and the body part encompasses and is fixedly secured to and is situated slightly above and surrounding the front and rear wheel chambers.

To prevent the rear trunk from billowing outward and loosing its generally rectangular shape, there is an internal web 50 as seen in FIG. 10 which extends generally vertically from bottom to top, being situated behind the rear wheels. This web connects at junction 51 to the trunk top 51A and panel 51B extending from the rear of the passenger compartment. Forward of web 50 is another web 52 which is slightly forward of the rear wheel and extends from the bottom of the car 53 to junction 54 at the bottom of passenger compartment 14. This allows inflation of the area below the passenger compartment in the area of arrow 55 without allowing said area to push upward into and deform the passenger compartment; web 52 also supports the car's bottom 53 from deforming downward below the level of the bottom of the tires, as shown. There is a similar web 55 slightly behind the front wheel and extending from the bottom of the car upward to a junction 56 of the inner section of the front of the passenger compartment and the rear of the hood. And finally there is another web 57 forward of the front wheel and extending from the bottom of the car to the top of the hood to make sure that the top of the hood 58 remains generally flat while it is inflated.

The cross-sectional view FIG. 8 illustrates construction of wheel 61 and wheel well 62. The inner wall 60 of the front left wheel well 62 is a portion of the end wall of cylindrical chamber 36 defined by cylinder 34. Because of this wall 34 the area 63 of the wheel well cannot extend outward in the direction of arrow 64, and thus the wheel well housing 65 is well defined as separate from the tire tred 66, similarly as in a real car. Also, part 65A of the wheel well cannot extend downwardly in the direction of arrow 67 because of the limiting aspect of wall 68 which is maintained in position by top wall 69. In conclusion, the general shape of the wheel well is maintained so that the wheel 16 can remain clearly defined within the wheel well and achieve the previously discussed aspect of substantial realism as regards a racing car.

The rear trunk area as described earlier is maintained in shape partly because the internal web 50 shown in FIG. 10 prevents the trunk deck 51A from billowing upward. Also the rear wall 80 seen in FIG. 10 further helps to restrain or maintain the basic trunk shape. The spoiler 81 extending transversely across the rear of the trunk has its own internal air chamber 82 which receives air from the general trunk area via apertures 83.

Now consider FIG. 7 which is a cross-sectional view taken through the car along line 7—7 of FIG. 4. Part 102 is the bottom skin of the automobile housing. And area 103 is part of the fourth air chamber that extends from the trunk along the bottom of the car beneath the passenger compartment to the front hood area, while passing around the two wheel assemblies. This bottom surface or bottom skin 102 of the car is prevented from billowing downward to the ground by internal webs 104A, 104B and 104C which extend as restraints or generally vertical walls which are joined along typical heat seal areas 105 to the passenger compartment and at area 106 to the bottom wall 102.

Thus, the fourth air chamber extends from the trunk area and valve 20V to include the spoiler 82, the trunk 20, then down below the passenger compartment in area 103 is seen in FIG. 7, and extending forward past the front wheels to the hood area 22.

The four air chamber components of this vehicle are made of thin, flexible substantially air-impervious thermoplastic such as polyvinyl chlorides, polyolefins and polyesters having thickness in the range of 20 mm to 50 mm. These elements are heat sealed or otherwise joined together in a standard manner common in the industry. The four valves are also typical of valves heat sealed to air chambers as used in this industry. The artwork visible on the outside of the inflatable vehicle is applied thereto by silk screen, painting, printing or other techniques typical in the industry.

The model car described above can be considered as a construction of four separate air chambers, some having common walls for both economy and strength. As is known, a long thin cylinder has less rigidity then a cylinder of greater diameter. Here the car's tires are constructed as ends of relatively large diameter cylinders. This provides strength to each front and rear wheel-set, and also strength to the car as a whole against bending and twisting, particularly with respect to an axis extending side-to-side of the car.

In the embodiment shown the diameter of the tires and of their connecting air chambers are about 50% of the car's height, and the height of the passenger compartment is about 75% of the car's height. These comparative dimensions are substantially variable, depending on the selection of component shapes and construction techniques.

With regard to the longitudinal axis, the car has great strength against bending and twisting due to the shape and size of the passenger compartment relative to the remainder of the body. The compartment in axial and transverse cross-section is generally oval or teardrop, or in the most general sense a partially flattened sphere, all of which shapes have great inherent strength against bending and twisting.

By using a common wall for the bottom of the passenger compartment and the top of the car body, the great strength of the passenger compartment is automatically transferred to the body. Similarly, the great strength of the wheel-sets with their wide diameter central chambers is transferred to the car's body.

The shape of the passenger compartment also adds realism to this model car as it provides a large open and unobstructed interior, and where the bottom of this compartment hides from view all the interior structure, such as the restraining webs 50, 52, 55 etc. and the wheel wells and wheel-sets and various valves.

As a variation, the car could be constructed of fewer independently inflatable chambers or where all the chambers have contiguous air spaces. However, this would entail more intricate internal construction, and the construction shown was preferred when weighing manufacturing, costs and strength criteria. In further variations the magnitude of the diameter of the wheels, the height of the passenger compartment and the overall height of the car may vary, however, the proportions shown herein were selected for strength and realism.

The above described preferred embodiment illustrates one form of the invention. The claims appended hereto set forth the scope of the invention which may include numerous structures and forms different from the above-described preferred embodiment but still within the spirit and scope of the claims hereto.

I claim:

1. An inflatable model car made of flexible air-impervious sheet material, the car comprising first, second, third and fourth separate air chambers forming respectively a front wheel-set, a rear wheel-set, a simulated passenger compartment and a body, each of said wheel-sets formed as an elongated central chamber having opposite ends formed generally as tires, said wheel-sets disposed generally parallel to and spaced apart from each other, said simulated passenger compartment comprising a roof and an opposite bottom, the body having top and bottom parts, said body generally at least partially enclosing and secured to said wheel-sets and said simulated passenger compartment situated atop and secured to said body top, said car further comprising valve means for inflating each of said chambers.

2. Apparatus according to claim 1 wherein for each of said wheel-sets said central chamber comprises a cylinder having outer diameter D1, and said tires have outer diameter generally similar to D1.

3. Apparatus according to claim 1 wherein said body has front and rear portions respectively for said at least partially enclosing said first and second wheel-sets.

4. Apparatus according to claim 3 wherein said body further comprises a central area between said front and rear portions to which said simulated passenger compartment is secured.

5. Apparatus according to claim 1 wherein the central chamber for each of said wheel-sets has opposite ends axially inward of said tires, and said opposite ends are secured to said body, whereby said tires' outer surface is spaced apart from said body.

6. Apparatus according to claim 4 wherein the bottom of said simulated passenger compartment and the top of said body comprise a common sheet.

7. Apparatus according to claim 1 wherein the central chamber for each of said wheel-sets has opposite ends axially inward of said tires, and each tire has outer and inner sides, and each of said opposite ends of a central chamber and the inner wall of each tire comprise a common sheet.

8. Apparatus according to claim 5 wherein said body further defines a wheel well as a housing partially surrounding each tire, each tire has a tred portion as an outer radial surface, each of said housings comprising sheet material adjacent and radially spaced from a tire tred.

9. Apparatus according to claim 2 wherein each tire is a torroid comprising outer diameter and inner diameter cylinders and side walls joining said outer and inner cylinders.

10. Apparatus according to claim 9 wherein said inner and outer cylinders have generally the same axial length, and said inner cylinder comprises a restraint for holding said side walls generally flat when said tire is inflated.

11. Apparatus according to claim 10 wherein each of said front and rear wheel sets is an air chamber comprising a central chamber and the torroid part of a tire, and wherein the inner cylinder of each wheel defines a bore having an outer end, and each wheel further comprises a hubcap wall closing said outer end of said bore, said bore defining a space for containing ambient air separate from the inflatable air chambers within said torroid of the tire and the central chamber thereof.

12. Apparatus according to claim 2 wherein the car has overall height H1, and for each tire the outer diameter is about 50% H1.

13. Apparatus according to claim 4 wherein said simulated passenger compartment comprises a generally oval shape in both axial and transverse cross-sections.

14. Apparatus according to claim 13 wherein the car has overall height H1, and said simulated passenger compartment has height H2 about 75% of H1.

15. Apparatus according to claim 1 wherein said body defines trunk and hood areas respectively rearward and forward of the rear and front wheel-sets, and wherein the air chamber of said body extends contiguously from said trunk area, above said rear wheel-set, under the simulated passenger compartment, over the front wheel-set and into said hood area.

16. Apparatus according to claim 3 wherein each of said wheel sets each has a bottom part, further comprising first restraining means for restraining the body's bottom from extending downward below said bottom parts of said wheel sets when the car is inflated, said first restraining means comprising an internal web of said sheet material extending between said top and bottom parts of said body and situated rearward of said front wheel-set and forward of said rear wheel-set.

17. An inflatable model car made of flexible air-impervious sheet material, the car comprising first, second, third and fourth separate air chambers forming respectively a front wheel-set, a rear wheel-set, a simulated passenger compartment and a body, each of said wheel-sets formed as an elongated central chamber having opposite ends formed generally as tires, said wheel-sets disposed generally parallel to and spaced apart from each other, said simulated passenger compartment comprising a roof and an opposite bottom, the body having top and bottom parts, said body generally enclosing and secured to said wheel-sets and said simulated passenger compartment situated atop and secured to said body top, said car further comprising valve means for inflating each of said chambers, wherein each tire is a torroid comprising outer diameter and inner diameter cylinders and side walls joining said outer and inner cylinders.

18. Apparatus according to claim 17 wherein said inner and outer cylinders have generally the same axial length, and said inner cylinder comprises a restraint for holding said side walls generally flat when said tire is inflated.

19. Apparatus according to claim 18 wherein the inner cylinder of each wheel defines a bore having an outer end, and each wheel further comprises a hubcap wall closing said outer end of said bore, said bore defining a space for containing ambient air separate from the inflatable air chambers within said torroid of the tire and the central chamber thereof.

20. An inflatable model car made of flexible air-impervious sheet material, the car comprising air chambers forming front and rear wheel-sets, a simulated passenger compartment and a body, each of said wheel-sets formed as an elongated central chamber having opposite ends formed generally as tires, said wheel-sets disposed generally parallel to and spaced apart from each other, said simulated passenger compartment comprising a roof and an opposite bottom, the body having top and bottom parts, said body at least partially enclosing and secured to said wheel-sets and said simulated passenger compartment situated atop and secured to said body top, said car further comprising valve means for inflating said chambers.

* * * * *